United States Patent [19]

Gruber

[11] 4,390,675

[45] Jun. 28, 1983

[54] CURABLE COMPOSITION AND USE THEREOF

[75] Inventor: Bruce A. Gruber, Worthington, Ohio

[73] Assignee: Ashland Oil, Inc., Ashland, Ky.

[21] Appl. No.: 300,788

[22] Filed: Sep. 10, 1981

[51] Int. Cl.[3] ..... C08F 24/00

[52] U.S. Cl. ..... 526/273; 525/327.3; 526/75

[58] Field of Search ..... 526/75, 273; 525/326, 525/327.3

[56] References Cited

U.S. PATENT DOCUMENTS

| | | | |
|---|---|---|---|
| 3,409,579 | 11/1968 | Robins | 523/143 |
| 3,429,848 | 2/1969 | Robins | 523/143 |
| 3,632,844 | 1/1972 | Robins | 523/143 |
| 3,676,392 | 7/1972 | Robins | 260/DIG. 40 |
| 3,905,934 | 9/1975 | Gardikes | 260/DIG. 40 |
| 3,930,872 | 1/1976 | Toeniskoetter et al. | 106/38.3 |
| 4,089,692 | 5/1978 | Toeniskoetter et al. | 106/38.3 |
| 4,127,157 | 11/1978 | Gardikes | 106/38.3 |
| 4,209,056 | 6/1980 | Gardikes | 106/38.3 |
| 4,320,218 | 3/1982 | Gruber et al. | 526/308 |

*Primary Examiner*—Harry Wong, Jr.
*Attorney, Agent, or Firm*—Pollock, Vande Sande & Priddy

[57] ABSTRACT

A composition which contains certain epoxidized materials and/or prepolymers thereof, and an acidic catalyst; and use thereof.

12 Claims, No Drawings

CURABLE COMPOSITION AND USE THEREOF

DESCRIPTION

1. Technical Field

The present invention is directed to compositions employing certain binders which are capable of being cured at normal room temperatures. The compositions are capable of being cured at normal room temperatures by a gaseous curing agent or an acidic catalyst incorporated into the binder. The compositions of the present invention are particularly useful as foundry binders.

2. BACKGROUND ART

In the foundry art, cores and molds used in making metal castings are generally prepared from shaped, cured mixtures of aggregate material (e.g., sand) and a binder. One of the preferred techniques of making these sand cores includes the basic steps of mixing the sand with a resin binder and a curing catalyst, molding the mixture to the desired shape and allowing it to cure and solidify at room temperature without the application of heat. Resins useful in this technique include the furfuryl alcoholformaldehyde, furfuryl alcohol-urea-formaldehyde, and alkyd isocyanate resins as well as sodium silicate binders. Such technique is commonly referred to as a "no bake" process.

Another technique employed includes the basic steps of mixing the aggregate with a resin binder, molding the mixture to the desired shape, and curing the shape by passing a gaseous catalyst through it. This technique is often referred to as the "cold box" method.

Binders which are suitable for use in such processes must possess a number of important characteristics. For instance, the binders must be capable of providing relatively high strength characteristics to the molded article and must be capable of curing to considerable degree at normal room temperatures. Also, since curing of the binders occurs while as a thin layer of film on the aggregate and the aggregate can act as a heat sink, the curing does not necessarily proceed in the same manner as when the binder is cured in bulk. In addition, foundry cores and molds must retain the strength properties until the metal solidifies in the mold, but must lose such properties due to their exposure at higher temperatures so that after solidification of the metal, the cores or molds can readily be broken down for shake-out or removal from the casting. Accordingly, providing new binders for foundry applications which contain the necessary properties is quite difficult. This problem is made more acute when the object is a relatively inexpensive binder.

It has also been discovered that fulvenes and/or fulvene prepolymers could be employed as binders for foundry applications as described in U.S. Pat. No. 4,246,167 entitled "Foundry Binder Composition" to Grimm, et al., and assigned to Ashland Oil, Inc., the assignee of the present application. However, the use of fulvenes has not been entirely satisfactory since such are somewhat susceptible to degradation from atmospheric oxygen and have an unpleasant odor. Also fulvenes employed have been somewhat discolored which detracts from their commercial appeal.

DISCLOSURE OF THE INVENTION

The present invention provides compositions which are especially suitable as foundry binders with improved resistance to atmospheric oxygen, reduced odor and reduced discolorations as compared to the fulvenes discussed hereinabove.

The present invention is directed to a curable composition which includes an epoxidized fulvene and/or prepolymer thereof; and an acidic catalyst. The epoxidized fulvenes employed are represented by the formula:

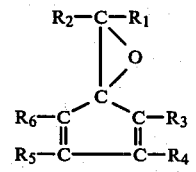

Each $R_1$ and $R_2$ individually is hydrogen or a hydrocarbon containing 1–10 carbon atoms, or a hydrocarbon containing one or more oxygen bridges in the chain thereof, or a furyl group, or are interconnected and, together with the carbon atom to which they are connected, form a cyclic group. Each $R_3$, $R_4$, $R_5$ and $R_6$ individually is hydrogen or methyl, provided that a maximum of only one such $R_3$, $R_4$, $R_5$ and $R_6$ is methyl. In addition, if excess aldehyde or ketone is employed in the preparation of the fulvene, $R_4$ or $R_5$ can have the structure:

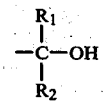

In such a case, $R_3$ and $R_6$ will be as previously discussed. The composition also contains an acidic catalyst having a pKa of about 4 or less. The acidic catalyst is incorporated into the composition prior to molding or is provided by passing a gas through the molded composition.

The present invention is also concerned with molding compositions which include a major amount of aggregate and an effective bonding amount up to about 40% by weight of the aggregate of the above-defined curable composition.

The present invention is also directed to a process for the fabrication of molded articles which includes the following steps:

(a) mixing aggregate with a bonding amount up to about 40% by weight based upon the weight of the aggregate of a binder composition of the type described hereinabove which contains the acidic catalyst;

(b) introducing the composition obtained from step (a) into a pattern;

(c) hardening the composition in the pattern to become self-supporting; and (d) thereafter removing the shaped article of step (c) from the pattern and allowing it to further cure, thereby obtaining a hardened, solid, cured, molded article.

The present invention is also concerned with a process for the fabrication of molded articles which comprises:

(a) mixing the aggregate with a bonding amount up to about 40% by weight based upon the weight of the aggregate of an epoxidized fulvene of the formula:

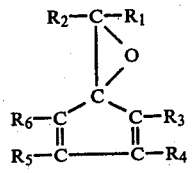

wherein each $R_1$ and $R_2$ individually is hydrogen or a hydrocarbon containing 1 to 10 carbon atoms, or a hydrocarbon containing one or more oxygen bridges in the chain; or a furyl group; or are interconnected to form a cyclic group; each $R_3$, $R_4$, $R_5$ and $R_6$ individually is hydrogen or methyl, provided that a maximum of only one such $R_3$, $R_4$, $R_5$ and $R_6$ is methyl, and when excess aldehyde or ketone is employed in the preparation of the fulvene, $R_4$ or $R_5$ can have the structure:

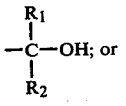

prepolymer thereof or mixtures thereof;

(b) introducing the composition obtained from step (a) into a pattern;

(c) hardening the composition in the pattern to become self-supporting by passing an acidic gas through the composition and (d) thereafter removing the shaped article of step (c) from the pattern and allowing it to further cure, thereby obtaining a hardened, solid, cured, molded article.

The present invention is also concerned with a process for casting a metal which includes fabricating a shape as described hereinabove, pouring metal while in the liquid state into or around the shape, allowing the metal to cool and solidify, and then separating the molded metal article.

BEST AND VARIOUS MODES FOR CARRYING OUT INVENTION

The monomeric epoxidized fulvenes employed according to the present invention and from which dimeric and higher epoxidized fulvenes are formed which are employed according to the present invention are represented by the formula:

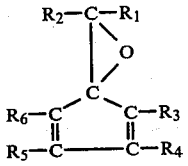

Each $R_1$ and $R_2$ individually is hydrogen or hydrocarbon containing 1 to 10 carbon atoms, or a hydrocarbon containing 1 or more oxygen bridges in the chain and containing up to 10 carbon atoms; or a furyl group; or are interconnected and together with the carbon atoms to which they are interconnected form a cyclic group. The hydrocarbon groups can be free from nonbenzenoid unsaturation or can include ethylenic unsaturation. Examples of some hydrocarbon groups include alkyl groups, such as methyl, ethyl, propyl, and butyl; aryl groups, such as phenyl and naphthyl; alkaryl groups, such as benzyl; aralkyl groups; and ethylenically unsaturated groups, such as vinyl. An example of a hydrocarbon containing at least one oxygen bridge in the chain is methoxypentylidene. Examples of some cyclic groups include cycloaliphatic groups, such as cyclopentyl, cyclohexyl, and cycloheptyl.

$R_3$, $R_4$, $R_5$ and $R_6$ each individually is hydrogen or methyl, provided that a maximum of only one $R_3$, $R_4$, $R_5$ or $R_6$ is methyl. Mixtures of the fulvenes can be used when desired.

In addition, prepolymers and especially dimers of the above epoxidized fulvenes can be used in place of or in combination with the fulvenes provided they still contain sufficient epoxide functionality, (e.g., at least about 8% oxirane) for subsequent curing to provide the needed strength characteristics and properties for molded articles, and especially for foundry shapes, and are still fluid enough so that when applied either per se or in admixture with the diluents will flow to coat the aggregate. Mixtures of epoxidized fulvene prepolymers can be used.

In addition, if excess aldehyde or ketone is employed in the preparation of the fulvene, $R_4$ or $R_5$ can have the structure:

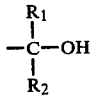

In such a case, $R_3$ and $R_6$ will be as previously described.

Examples of some fulvenes from which the epoxidized fulvenes are derived are dimethylfulvene ($R_1$ and $R_2$ are methyl; and $R_3$, $R_4$, $R_5$ and $R_6$ are H); methylisobutylfulvene ($R_1$ is methyl; $R_2$ is isobutyl; $R_3$, $R_4$, $R_5$ and $R_6$ are H); methylphenylfulvene ($R_1$ is phenyl; $R_2$ is methyl; $R_3$, $R_4$, $R_5$ and $R_6$ are H); cyclohexylfulvene ($R_1$ and $R_2$ are interconnected and form a cyclohexyl ring with the common carbon atom to which they are connected; $R_3$, $R_4$, $R_5$ and $R_6$ are H).

Fulvenes have been known for many years as well as their method of preparation. Also, it has been known that fulvenes polymerize in the presence of acids. The fulvenes employed according to the present invention can be prepared by reacting a carbonyl compound (e.g.,—ketones and aldehydes) with cyclopentadiene and/or methylcyclopentadiene in the presence of a basic catalyst, such as a strong base (e.g., KOH), an amine, and basic ion exchange resins. Suggestions of methods for preparing fulvenes can be found in U.S. Pat. Nos. 2,589,969; 3,051,765; and 3,192,275. In addition, fulvenes can be purified by distillation according to method by Kice, J. Am. Chem. Soc. 80, 3792 (1958), and the method of McCaine, J. Chem. Soc. 23, 632 (1958).

Moreover, epoxidized derivatives of fulvenes and method for obtaining such have been described in the literature. For instance, see Alder, et al., Uber Einen Einfachen Weg Von Den Fulvenen in Die Reihe Des 6,6—Disubstituierten Cyclohexadienens, Chemische Berichte Vol. 90, pages 1709-1719 (1957).

The epoxidized derivatives of the fulvenes can be prepared by oxidation of the precursor fulvenes. For instance, the fulvenes can be oxidized by a solution oxidation process employing an oxidizing agent such as an aqueous hydrogen peroxide in the presence of a basic catalyst such as alkali metal and alkaline earth metal hydroxides including KOH, NaOH and $Mg(OH)_2$.

Examples of some suitable solvents include alcohols such as methanol, ethanol, and isopropanol. The temperature of the reaction is desirably about 20° C. or less. The time of reaction is usually about 1 to about 5 hours. In many cases, the epoxidized fulvene dimerizes in situ.

In addition, the composition of the present invention contains an acid catalyst. The acid catalysts employed have a pKa value of 4 or less and include organic acids such as formic acid, oxalic acid, and the organic substituted sulfonic acids such as benzenesulfonic acid and toluenesulfonic acid and Lewis acids such as $BF_3$. The acid catalyst can be provided in the foundry mix before molding (e.g.—"no bake" process), and/or by passing a gas through the molded composition such as an acid per se (e.g., $BF_3$) or a gas such as $SO_2$ which in conjunction with a component of the molded composition (e.g., a peroxide) forms an acid in situ.

The acid when already in the mix prior to molding is generally present in amounts up to a maximum of about 3% by weight based upon the amount of binder employed. The minimum amount of acidic catalyst is usually about 0.8 percent based upon the amount of binder employed. When employing a "cold box" process usually up to about 5 seconds of gassing time is sufficient.

The epoxidized fulvenes and/or prepolymers thereof can be employed in combination with other epoxy polymers, and/or the fulvene precursors from which they are obtained, and/or with furfuryl alcohol and/or furan prepolymer foundry binder systems.

Examples of suitable epoxy polymers include epoxidized novolak polymers, glycidyl ethers of a polynuclear dihydric phenol and reaction products thereof with polymers terminated with reactive groups. Preferably the epoxies employed are liquid. The preferred types of epoxy polymers are the polyepoxides of epichlorohydrin and bisphenol-A, i.e., 2,2-bis (p-hydroxyphenyl) propane. Other suitable epoxies as stated hereinabove include those obtained by reacting a polynuclear dihydric phenol with haloepoxy alkane in general.

Suitable polynuclear dihydric phenols can have the formula:

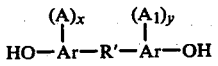

wherein Ar is an aromatic divalent hydrocarbon such as naphthalene and, preferably, phenylene, A and $A_1$ which can be the same or different are alkyl radicals, preferably having from 1 to 4 carbon atoms, halogen atoms, e.g., fluorine, chlorine, bromine and iodine, or alkoxy radicals, preferably having from 1 to 4 carbon atoms, x and y are integers having a value 0 to a maximum value corresponding to the number of hydrogen atoms on the aromatic radical (Ar) which can be replaced by substituents and R' is a bond between adjacent carbon atoms as in dihydroxydiphenyl or is a divalent radical including, for example,

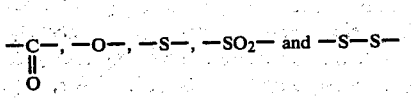

and divalent hydrocarbon radicals, such as alkylene, alkylidene, cycloaliphatic, e.g., cycloalkylene, halogenated, alkoxy or aryloxy substituted alkylene, alkylidene and cycloaliphatic radicals as well as aromatic radicals including halogenated, alkyl, alkoxy or aryloxy substituted aromatic radicals and a ring fused to an Ar group; or R' can be polyalkoxy, or polysiloxy, or two or more alkylidene radicals separated by an aromatic ring, a tertiary amino group, an ether linkage, a carbonyl group or a sulfur containing group such as sulfoxide, and the like.

Examples of specific dihydric polynuclear phenols include, among others, the bis-(hydroxyphenyl) alkanes such as 2,2-bis-(4-hydroxyphenyl) propane, bis-(2-hydroxyphenyl) methane, bis-(4-hydroxyphenyl) methane, bis-(4-hydroxy-2,6-dimethyl-3-methoxyphenyl) methane, 1,1-bis-(4-hydroxyphenyl) ethane, 1,2-bis-(4-hydroxyphenyl) ethane, 1,1-bis(4-hydroxy-2-chlorophenyl) ethane, 1,1-bis(3-methyl-4-hydroxyphenyl) propane, 2,2-bis-(3-phenyl-4-hydroxyphenyl) propane, 2,2-bis(2-isopropyl-5-hydroxyphenyl) propane, 2,2-bis(4-hydroxynaphthyl) pentane, bis-(4-hydroxyphenyl) phenylmethane, bis-(4-hydroxyphenyl) cyclohexylmethane, 1,2-bis-(4-hydroxyphenyl)-1,2-bis-(phenyl) propane and 2,2-bis-4(hydroxyphenyl)-1-phenyl propane; di(hydroxyphenyl) sulfones such as bis(4-hydroxyphenyl) sulfone, 2,4' dihydroxydiphenyl sulfone, 5'-chloro-2,4'-dihydroxydiphenyl sulfone, and 5'-chloro-2,2'-dihydroxydiphenyl sulfone, and 5'-chloro-4,4'-dihydroxydiphenyl sulfone; di(hydroxyphenyl) ethers such as bis-(4-hydroxyphenyl) ether, the 4,3'-, 4,2'-, 2,2'-, 3,3'-, 2,3'-, dihydroxydiphenyl ethers, 4,4'-dihydroxy-3,6-dimethyldiphenyl ether, bis-(4-hydroxy-3-isobutylphenyl) ether, bis-(4-hydroxy-3-isopropylphenyl)ether, bis-(4-hydroxy-3-chlorophenyl)-ether, bis-(4-hydroxy-3-fluorophenyl)ether, bis-(4-hydroxy-3-bromo-phenyl) ether, bis-(4-hydroxynaphthyl)ether, bis-(4-hydroxy-3-chloronaphthyl)ether, bis-(2-hydroxydiphenyl)ether, 4,4'-dihydroxy-2,6-dimethoxydiphenyl ether, and 4,4'-dihydroxy-2,5-diethoxydiphenyl ether.

The preferred dihydric polynuclear phenols are represented by the formula:

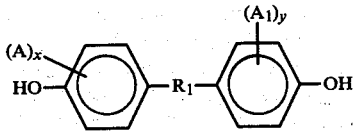

wherein A and $A_1$ are as previously defined, x and y have values from 0 to 4 inclusive and $R_1$ is a divalent saturated aliphatic hydrocarbon radical, particularly alkylene and alkylidene radicals having from 1 to 3 carbon atoms and cycloalkylene radicals having up to and including 10 carbon atoms. The most preferred dihydric phenol is bisphenol-A, i.e., 2,2-bis(p-hydroxyphenyl) propane.

The halo-epoxy alkane can be represented by the formula:

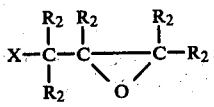

wherein X is a halogen atom (e.g., chlorine, bromine, and the like), each $R_2$ individually is hydrogen or alkyl group of up to 7 carbon atoms; wherein the number of carbon atoms in any epoxy alkyl group generally totals no more than 10 carbon atoms.

While glycidyl ethers, such as derived from epichlorohydrin, are particularly preferred, the epoxy polymers containing epoxy-alkoxy groups of a greater number of carbon atoms are also suitable. These are prepared by substituting for epichlorohydrin such representative corresponding chlorides or bromides of monohydroxy epoxyalkanes as 1-chloro-2,3-epoxybutane, 2-chloro-3,4-epoxybutane, 1-chloro-2-methyl-2,3-epoxypropane, 1-bromo-2,3-epoxypentane, 2-chloromethyl-1,2-epoxybutane, 1-bromo-4-ethyl-2,3-epoxypentane, 4-chloro-2-methyl-2,3-epoxypentane, 1-chloro-2,3-epoxyoctane, 1-chloro-2-methyl-2,3-epoxyoctane, or 1-chloro-2,3-epoxydecane.

The epoxidized novolaks can be represented by the formula:

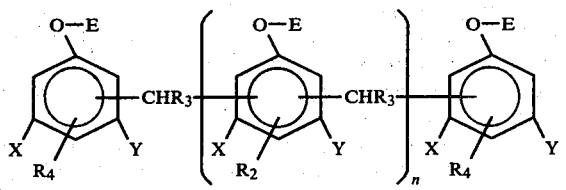

wherein n is at least about 0.2; E is hydrogen or an epoxyalkyl group, at least two E groups per polymer molecule being an epoxyalkyl group and wherein the epoxyalkyl group is represented by the formula:

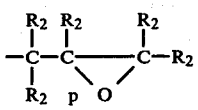

$R_3$ is hydrogen or alkyl or alkylene or aryl or aralkyl or cycloalkyl or furyl group; each $R_2$ individually is hydrogen or alkyl group of up to 7 carbon atoms; wherein the number of atoms in any epoxyalkyl group totals no more than 10 carbon atoms; each X and Y is individually hydrogen or chlorine or alkyl or hydroxyl; each $R_4$ individually is hydrogen or chlorine or a hydrocarbon group. Preferably, substantially all of the E groups are epoxyalkyl groups. Generally $R_3$, X, Y and $R_4$, when hydrocarbons, contain no more than about 12 carbon atoms.

The epoxy novolaks can be prepared by known methods by the reaction of a thermoplastic phenolic-aldehyde polymer of a phenol having the formula:

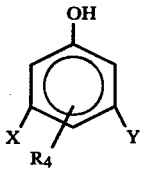

wherein X, Y and $R_4$ have the meaning as defined above with a halo-epoxy alkane of the formula:

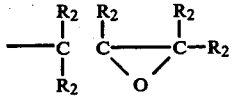

wherein X is a halogen atom (e.g., chlorine, bromine, and the like) and $R_2$ have the same meanings as defined hereinabove.

Hydrocarbon-substituted phenols having two available positions ortho or para to a phenolic hydroxy group for aldehyde condensation to provide polymers suitable for the preparation of epoxy novolaks include o- and p-cresols, o- and p-ethyl phenols, o-and p-isopropyl phenols, o- and p-ethyl phenols, o- and p-secbutyl phenols, o- and p-amyl phenols, o- and p-octyl phenols, o- and p-nonyl phenols, 2,5-xylenol, 3,4-xylenol, 2,5-diethyl phenol, 3,4-diethyl phenol, 2,5-diisopropyl phenol, 4-methyl resorcinol, 4-ethyl resorcinol, 4-isopropyl resorcinol, 4-tertbutyl resorcinol, o- and p-benzyl phenyl, o- and p-phenethyl phenols, o- and p-phenyl phenols, o- and p-tolyl resorcinol, 4-cyclohexyl resorcinol.

Various chloro-substituted phenols which can also be used in the preparation of phenol-aldehyde resins suitable for the preparation of the epoxy novolaks include o- and p-chloro phenols, 2,5-dichloro phenol, 2,3-dichloro phenol, 3,4-dichloro phenol, 2-chloro-3-methyl phenol, 2-chloro-5-methyl phenol, 3-chloro-2-methyl phenol, 5-chloro-2-methyl phenol, 3-chloro-4-methyl phenol, 4-chloro-3-methyl phenol, 4-chloro-3-ethyl phenol, 4-chloro-3-isopropyl phenol, 3-chloro-4-phenyl phenol, 3-chloro-4-chlorophenyl phenol, 3,5-dichloro-4-methyl phenol, 3,5-dichloro-2-methyl phenol, 2,3-dichloro-5-methyl phenol, 2,5-dichloro-3-methyl phenol, 3-chloro-4,5-dimethyl phenol, 4-chloro-3,5-dimethyl phenol, 2-chloro-3,5-dimethyl phenol, 5-chloro-2,3-dimethyl phenol, 5-chloro-3,4-dimethyl phenol, 2,3,5-trichlorophenol, 3,4,5-trichloro phenol, 4-chloro resorcinol, 4,5-dichloro resorcinol, 4-chloro-5-methyl resorcinol, and 5-chloro-4-methyl resorcinol.

Typical phenols which have more than two positions ortho or para to a phenolic hydroxy group available for aldehyde condensation and which, by controlled aldehyde condensation, can also be used are: phenol, m-cresol, 3,5-xylenol, m-ethyl and m-isopropyl phenols, m,m'-diethyl and diisopropyl phenols, m-butyl-phenols, m-amyl phenols, m-octyl phenols, m-nonyl phenols, resorcinol, 5-methyl-resorcinol, 5-ethyl resorcinol.

As condensing agents any aldehyde may be used which will condense with the particular phenol being used, including formaldehyde, acetaldehyde, propionaldehyde, butyraldehyde, heptaldehyde, benzaldehyde, and nuclear alkyl-substituted benzaldehydes, such as toluic aldehyde, naphthaldehyde, furfuraldehyde, glyoxal, acrolein, or compounds capable of engendering aldehydes such as para-formaldehyde, and hexamethylene tetramine. The aldehydes can also be used in the form of a solution, such as the commercially available formalin.

While glycidyl ethers, such as derived from epichlorohydrin, are preferred, the epoxy novolak polymers can contain epoxy-alkoxy groups of a greater number of carbon atoms. These are prepared by substituting for epichlorohydrin such representative corresponding chlorides or bromides of monohydroxy epoxyalkanes as 1-chloro-2,3-epoxybutane, 2-chloro-3,4-epoxybutane, 1-chloro-2-methyl-2,3-epoxy-propane, 1-bromo-2,3-epoxypentane, 2-chloromethyl-1,2-epoxybutane, 1-bromo-4-ethyl-2,3-epoxypentane, 4-chloro-2-methyl-2,3-epoxypentane, 1-chloro-2,3-epoxyoctane, 1-chloro-2-methyl-2,3-epoxyoctane, or 1-chloro-2,3-epoxydecane.

Preferred epoxidized novolaks are represented by the formula:

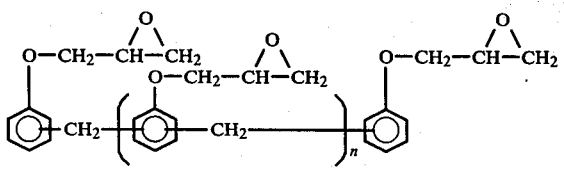

wherein n is at least about 0.2. The epoxidized novolak preferably is liquid and preferably n is less than about 1.5.

Examples of reaction products of glycidyl ethers with polymers terminated with reactive groups include reaction products of glycidyl ether of bisphenol A and epichlorohydrin with telechelic prepolymers (i.e.-prepolymers having the reactive groups capable of producing strong elastomeric structures). The prepolymers are usually liquids. Examples of some polymer chains include polysulfide, polyisobutylene; polybutadiene, butadiene-acrylonitrile copolymer, polyamide, polyether and polyester. The reactive terminal groups include thiol, carboxyl, hydroxyl, amine and isocyanate. A preferred telechelic prepolymer is carboxyl terminated butadiene-acrylonitrile prepolymer. Also, suitable epoxy polymers include epoxidized unsaturated oils such as epoxidized linseed oil and soybean oil. Such preferably have an oxirane content of about 7 to about 8% by weight.

The furan prepolymer include reaction products of furfuryl alcohol and of aldehydes such as formaldehyde, In addition, the aldehyde-furfuryl alcohol reaction product can be modified with varying amounts of reactants such as urea. The mole ratios of formaldehyde to furfuryl which can be employed can vary widely. For instance, the furan polymer can be prepared from about 0.4 to about 4 moles of furfuryl alcohol per mole of formaldehyde, and preferably from about 0.5 to about 2 moles of furfuryl alcohol per mole of formaldehyde.

The furan polymer which can be employed in the present invention can be any of the various furan polymers which are known to be suitable for molding and especially foundry purposes. Examples of such furan polymers include those obtained from about 1 mole of urea, about 0.2 to 2 moles of furfuryl alcohol and about 1 to 3 moles of formaldehyde such as described in U.S. Pat. Nos. 3,222,315 and 3,247,556. Other suitable furan polymers are disclosed in U.S. Pat. No. 3,346,534. The furan polymers are usually prepared by polymerization in the presence of an acid catalyst. Usually when a furan polymer is employed, it is added together with furfuryl alcohol.

When the epoxidized fulvenes are employed in admixture with other epoxy polymers, and/or furfuryl alcohol and/or fulvenes, and/or furan polymers such are generally employed in amounts of about 90 to about 50% by weight based upon the total amount of epoxidized fulvene and other materials defined above.

In addition, the compositions can contain a dialkyl ester of the formula:

$$R_1OOC(CH_2)_nCOOR_2$$

wherein $R_1$ and $R_2$ individually are alkyl of 1 to 20 carbon atoms and n is a whole number integer of 0 to 4. The ester may be blended with the binder and/or sand and/or in conjunction with the acidic catalyst. Suitable esters include dimethyl oxalate, diethyl oxalate, dimethyl succinate, methylethyl succinate, methyl-n-propyl succinate, methyl isopropyl succinate, methyl-n-butyl succinate, diethyl succinate, ethyl-n-propyl succinate, diisopropyl succinate, dibutyl succinate, dimethyl glutarate, methyl-ethyl glutarate, methyl-n-propyl glutarate, methyl-isopropyl glutarate, methyl-n-butyl glutarate, methyl-isobutyl glutarate, diethyl glutarate, ethyl-n-propyl glutarate, diisopropyl glutarate, dibutyl glutarate, dimethyl adipate, methylethyl adipate, methyl-n-propyl adipate, methyl-isopropyl adipate, diethyl adipate, dipropyl adipate, dibutyl adipate, dioctyl succinate, dioctyl adipate, octyl-nonyl glutarate, diheptyl glutarate, didecyl adipate, dicapryl adipate, dicapryl succinate, dicapryl glutarate, dilauryl adipate, dilauryl succinate and dilauryl glutarate, and malonic acid esters. Preferred esters for use are the oxalates. Other diluents can be employed if desired and include such groups of compounds as ketones such as acetone, diisoamylketone, and methylethyl ketone; ketoacids such as ethylacetoacetate and methylacetoacetate; and other esters such as the cellosolve esters. The dialkyl esters or other diluents may generally be employed in an amount of from about 0.5 to 30% and preferably 1 to 10% by weight of the binder.

When preparing an ordinary sand-type foundry shape, the aggregate employed has a particle size large enough to permit sufficient porosity in the foundry shape to permit escape of volatiles from the shape during the casting operation. The term "ordinary sand-type foundry shapes" as used herein refers to foundry shapes which have sufficient porosity to permit escape of volatiles from it during the casting operation. Generally, at least about 80%, and preferably about 90%, by weight of aggregate employed for foundry shapes has an average particle size no smaller than about 150 mesh (Tyler screen mesh). The aggregate for foundry shapes preferably has an average particle size between about 50 and about 150 mesh (Tyler screen mesh). The preferred aggregate employed for ordinary foundry shapes is silica sand wherein at least about 70 weight percent, and preferably at least about 85 weight percent of the sand is silica. Other suitable aggregate materials include zircon, olivine, aluminosilicate sand, chromite sand and the like.

When preparing a shape for precision casting, the predominant portion, and generally at least about 80% of the aggregate, has an average particle size no larger than about 150 mesh (Tyler screen mesh), and preferably between 325 mesh and 200 mesh (Tyler screen mesh). Preferably at least about 90% by weight of the aggregate for precision casting applications has a particle size no larger than 150 mesh and preferably between 325 mesh and 200 mesh. The preferred aggregates employed for precision casting applications are fused quartz, zircon sands, magnesium silicate sands such as olivine, and aluminosilicate sands.

Shapes for precision casting differ from ordinary sand-type foundry shapes in that the aggregate in shapes for precision casting can be more densely packed than the aggregate in shapes for ordinary sand-type foundry shapes. Therefore, shapes for precision casting must be heated before being utilized to drive off volatizable material present in the molding composition. If the volatiles are not removed from a precision casting shape before use, vapor created during casting will diffuse into the molten melt, since the shape has a relatively low porosity. The vapor diffusion would decrease the smoothness of the surface of the precision cast article.

When preparing a refractory, such as a ceramic, the predominant portion and at least about 80% by weight of the aggregate employed has an average particle size under 200 mesh and preferably no larger than 325 mesh. Preferably at least about 90% by weight of the aggregate for a refractory has an average particle size under 200 mesh, and preferably no larger than 325 mesh. The aggregate employed in the preparation of refractories must be capable of withstanding the curing temperatures, such as above about 1500° F. which are needed to cause sintering for utilization.

Examples of some suitable aggregate employed for preparing refractories include the ceramics, such as refractory oxides, carbides, nitrides, and silicides, such as aluminum oxide, lead oxide, chromic oxide, zirconium oxide, silica, silicon carbide, titanium nitride, boron nitride, molybdenum disilicide, and carbonaceous material, such as graphite. Mixtures of the aggregates can also be used, when desired, including mixtures of metals and the ceramics.

Examples of some abrasive grains for preparing abrasive articles include aluminum oxide, silicon carbide, boron carbide, corundum, garnet, emery and mixtures thereof. The grit size is of the usual grades as graded by the United States Bureau of Standards. These abrasive materials and their uses for particular jobs are understood by persons skilled in the art and are not altered in the abrasive articles contemplated by the present invention. In addition, inorganic filler can be employed along with the abrasive grit in preparing abrasive articles. It is preferred that at least about 85% of the inorganic fillers has an average particle size no greater than 200 mesh. It is most preferred that at least about 95% of the inorganic filler has an average particle size no greater than 200 mesh. Some inorganic fillers include cryolite, fluorospar, silica and the like. When an organic filler is employed along with the abrasive grit, it is generally present in amounts from about 1 to about 30% by weight based upon the combined weight of the abrasive grit and inorganic filler.

In molding compositions, the aggregate constitutes the major constituent and the binder constitutes a relatively minor amount. In ordinary sand type foundry applications, the amount of binder is generally no greater than about 10% by weight and frequently within the range of about 0.5 to about 7% by weight based upon the weight of the aggregate. Most often, the binder content ranges from about 0.6 to about 5% by weight based upon the weight of the aggregate in ordinary sand type foundry shapes.

In molds and cores for precision casting application the amount of binder is generally no greater than about 40% by weight and frequently within the range of about 5 to about 20% by weight based upon the weight of the aggregate.

In refractories, the amount of binder is generally no greater than about 40% by weight and frequently within the range of about 5% to about 20% by weight based upon the weight of the aggregate.

In abrasive articles, the amount of binder is generally no greater than about 25% by weight and frequently within the range of about 5% to about 15% by weight based upon the weight of the abrasive material or grit.

A valuable additive to the binder compositions of the present invention in certain types of sand is a silane having the general formula:

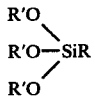

wherein R′ is a hydrocarbon radical and preferably an alkyl radical of 1 to 6 carbon atoms and R is a hydrocarbon group such as a vinyl group or an alkyl radical; an alkoxy-substituted alkyl radical; or an alkyl-amine-substituted alkyl radical in which the alkyl groups have from 1 to 6 carbon atoms. The aforesaid silane when employed in concentrations of about 0.05 to 2% based on the binder component of the composition improves the humidity resistance of the system.

Examples of some commercially available silanes are Dow Corning Z6040 and Union Carbide A-187 (gamma glycidoxy propyltrimethoxy silane); Union Carbide A-1100 (gamma aminopropyltriethoxy silane); Union Carbide A-1120 [N-beta(amino-ethyl)-gamma aminopropyltrimethoxy silane]; Union Carbide A-1160 (Ureido-silane); Union Carbide A-172 [vinyl-tris(beta methoxyethoxy)silane]; and vinyltriethoxysilane; Union Carbide A-186 (beta-3,4-epoxycyclohexyl)ethyltrimethoxysilane).

When the compositions of the present invention are used to prepare ordinary sand-type foundry shapes, the following steps are employed:

1. Forming a foundry mix containing an aggregate (e.g., sand) and the bonding agent;
2. Introducing the foundry mix into a mold or pattern to thereby form the desired shape;
3. Allowing the shape to obtain a minimum strength in the mold; and
4. Thereafter removing the shape from the mold or pattern allowing it to further cure thereby obtaining a hard solid cured foundry shape.

The foundry mix can optionally contain other ingredients such as iron oxide, ground flax fibers, wood cereals, pitch, refractory flours, and the like.

The systems of the present invention can be used for the casting of the relatively high melting point ferrous-type metals such as iron and steel which are poured at about 2,500° F., as well as for the casting of the relatively low melting point nonferrous type metals such as aluminum, copper, and copper alloys including brass.

In order to further understand the present invention, the following non-limiting examples concerned with foundry are provided. All parts are by weight unless the contrary is stated. The foundry samples are cured by the so-called "no-bake" process. Examples 1–4 represent some typical epoxidized fulvene preparations.

EXAMPLE 1

Preparation of 6,6-Dimethylfulvene Epoxide

Into a flask equipped with thermometer, stirrer and nitrogen inlet is charged about 20 g of KOH and about 600 ml methanol. The solution is cooled to 0° C. and about 106 g (1 mole) of dimethylfulvene is added. An equivalent amount of aqueous hydrogen peroxide is added at a rate to keep the temperature at 0° C. After complete addition, the flask is kept cool and the precipitate filtered. The product is recrystallized from petroleum ether. The product has a melting point of about 80–85° C.

EXAMPLE 2

Preparation of Methylethyl Fulvene Epoxide

The procedure of Example 1 is repeated except that methylethyl fulvene is employed in place of the dimethyl fulvene and after complete peroxide addition, an additional 300 ml water is added and extracted with petroleum ether. The organic layer is separated, dried, and evaporated leaving a light yellow oil, having an IR of 1223 cm-1 and refractive index n of 1.5125.

EXAMPLE 3

Preparation of Methyl-n-amyl Fulvene Epoxide

Example 2 is repeated except that methyl-n-amyl fulvene epoxide is used in place of the methyl ethyl fulvene. Evaporation of the organic layer gives a light yellow oil.

EXAMPLE 4

Preparation of 6,6-Dimethylfulvene Epoxide

In a flask equipped with thermometer, stirrer, $N_2$ inlet and dropping funnel is charged 23 ml methanol, 37 ml isopropyl alcohol and 21 g KOH. After dissolving the base, 66 g of distilled cyclopentadiene are added. When the solution is at 10° C., 58 g of acetone are added in 5 minutes with external cooling. The mixture is then heated at 50° C. for 30 minutes, then cooled with ice to 10°–15° C. The mixture is partially neutralized with 2N HCl to pH 9–10, then 35% aqueous hydrogen peroxide is added, maintaining the temperature at 10°–15° C., to completely oxidize the dimethylfulvene. The reaction is diluted with 100 ml water and cooled to precipitate the product. The product is recrystallized from petroleum ether: m.p. 80°–85° C.

EXAMPLE 5

Foundry sand mixes are prepared by admixing sand with the binder compositions shown in the Table below. The resulting foundry sand mixes are then formed into standard AFS tensile test samples using the standard procedures. The cured samples are tested for tensile strength and hardness.

The fulvene epoxide employed is methylethyl fulvene epoxide prepared according to Example 2. The silane is gamma-amino-propyltriethoxysilane and is employed in an amount of about 1% based on the binder. The catalyst is $BF_3.2H_2O$. The sand employed is Wedron Silica 5010. The binder is employed in an amount of about 1½% by weight based on the weight of the solids. The table gives tensile strengths in PSI and work time and strip time are in minutes.

EXAMPLE 6

A foundry sand mix is prepared by admixing Wedron Silica 5010 silica sand with a binder composition containing 70% by weight of methylethylfulvene epoxide and 30% by weight of Epon 828. The amount of binder is about 1.5% based on solids. The composition also contains about 1% based on the binder of the Union Carbide Silane A-1102. The resulting foundry sand mixes are then formed into standard AFS tensile text samples using the standard procedures. The curing process is a cold box method wherein the catalyst employed is a methyl ethyl ketone peroxide in an amount of 40% based upon the binder with $SO_2$ gas being blown in for 2 seconds followed by a 25 seconds air purge.

The samples have tensile strengths of 67 psi after 1 hour, 100 after 3 hours and 108 after 24 hours.

In addition, the cores are used in shakeout studies with aluminum castings. Seven dogbones are arranged in a mold. The mold incorporates a gating system. The mold is designed to provide hollow castings having a metal thickness of approximately one-quarter inch on all sides. An opening at the end of the casting is provided for removal of the core from the casting. Molten aluminum at approximately 1,300° F. is poured into the mold. After cooling the aluminum castings are broken from the gating system and removed from the mold for shakeout testings. After mechanically loosening the sand with a pointed file, the core is easily eliminated. Examination of the casting shows a good surface with slight discoloration.

What is claimed is:

1. A composition containing an epoxidized fulvene of the formula:

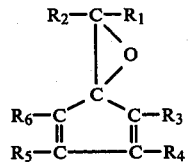

wherein each $R_1$ and $R_2$ individually is hydrogen or a hydrocarbon containing 1 to 10 carbon atoms, or a hydrocarbon containing one or more oxygen bridges in the chain; or a furyl group; or are interconnected to form a cyclic group, each $R_3$ and $R_6$ individually is hydrogen or methyl; each $R_4$ and $R_5$ individually is hydrogen or methyl or

TABLE I

| BINDER | CATALYST LEVEL (% based on binder) | WT/ST (Min.) | TENSILES, PSI 1 HR. | 3 HR. | 24 HR. |
|---|---|---|---|---|---|
| Methylethylfulvene Epoxide, 70%-Shell Epon 828, 30% | 8.3 | 14/59 | 5 | 20 | 143 |
| Methylethylfulvene Epoxide, 90%-Shell Epon 828, 10% | 8.3 | 14/55 | 5 | 30 | 148 |
| Methylethylfulvene Epoxide, 70%-Furfuryl Alcohol, 30% | 15.0 | 31/61 | 5 | 15 | 143 |
| Methylethylfulvene Epoxide, 75%-Shell Epon 828, 25% | 8.3 | 18/129 | 32 | 97 | 172 |
| Methylethylfulvene Epoxide, 85%-Shell Epon 828, 15% | 8.3 | 21/126 | 90 | 152 | 87 |
| Methylethylfulvene Epoxide, 90%-Shell Epon 828, 9%-Furfuryl Alcohol, 1% | 8.3 | 22/52 | 10 | 43 | 143 |
| Methylethylfulvene Epoxide, 75%-DCPD Diepoxide, 25% | 8.3 | 22/100 | 3 | 33 | 195 |
| Methylethylfulvene Epoxide, 75%-Epon 828, 25%-Dimethyloxalate, 5% (based on total epoxide) | 10.0 | 8/47 | 30 | 100 | 182 |

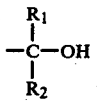

provided that a maximum of only one such $R_3$, $R_4$, $R_5$, and $R_6$ is methyl; and provided that a maximum of any one such $R_4$ and $R_5$ is

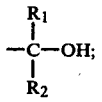

or prepolymer thereof or mixtures thereof, wherein said prepolymer contains at least about 8% oxirane and a catalytic amount of an acid catalyst having a pKa of about 4 or less.

2. The composition of claim 1 wherein the fulvene from which said epoxidized fulvene is derived is selected from the group consisting of dimethyl fulvene, methylisobutyl fulvene, methylisopentyl fulvene, methylphenyl fulvene, cyclohexyl fulvene, diisobutyl fulvene, isophorone fulvene, methylethyl fulvene, methyl pentylfulvene, and mixtures thereof.

3. The composition of claim 1 wherein said acid catalyst is present in an amount of about 0.8 to about 3% by weight based upon the weight of said epoxidized fulvene in the composition.

4. The composition of claim 1 wherein said epoxidized fulvene is epoxidized dimethyl fulvene.

5. The composition of claim 1 wherein said epoxidized fulvene is epoxidized ethylmethyl fulvene.

6. The composition of claim 1 wherein said prepolymer is a dimer.

7. The composition of claim 1 wherein said acid is selected from the group of organic acid, organic substituted sulfonic acid, and Lewis acid.

8. The composition of claim 7 wherein said acid is selected from the group of fumaric acid, oxalic acid, benzenesulfonic acid, toluenesulfonic acid, and $BF_3$.

9. The composition of claim 1 wherein said acid is formed in situ.

10. The composition of claim 9 wherein said acid is formed from $SO_2$ and peroxide.

11. The composition of claim 1 wherein said acid catalyst is a Lewis acid.

12. The composition of claim 1 wherein said acid catalyst is $BF_3$.

* * * * *